United States Patent [19]

Werner

[11] Patent Number: 4,832,344

[45] Date of Patent: May 23, 1989

[54] GOLF CLUB

[75] Inventor: Frank D. Werner, Jackson, Wyo.

[73] Assignee: Tech Line Corp., Jackson, Wyo.

[21] Appl. No.: 74,961

[22] Filed: Jul. 17, 1987

[51] Int. Cl.[4] ..... A63B 69/36; A63B 53/04

[52] U.S. Cl. ..... 273/163 R; 273/171; 273/172; 273/174

[58] Field of Search ..... 273/167 A, 174, 167 R, 273/167 E, 167 F, 169, 170, 171, 172, 163 R

[56] References Cited

U.S. PATENT DOCUMENTS

| | | | |
|---|---|---|---|
| D. 111,855 | 10/1938 | Moreno | 273/163 R |
| 1,289,192 | 12/1918 | Klin | 273/169 |
| 1,969,086 | 8/1934 | Luckett | 273/77 |
| 2,004,968 | 6/1935 | Young | 273/77 |
| 2,057,275 | 10/1936 | McKenna | 273/77 |
| 2,090,348 | 8/1937 | Ferry | 273/35 |
| 2,255,332 | 9/1941 | Russell | 273/77 |
| 2,328,583 | 9/1943 | Reach | 273/77 |
| 2,332,342 | 10/1943 | Reach | 273/77 |
| 3,199,873 | 8/1965 | Surratt | 273/167 A |
| 3,680,868 | 8/1972 | Jacob | 273/174 |
| 3,719,363 | 3/1973 | Harrison | 273/186 A |
| 4,291,883 | 9/1981 | Smart et al. | 273/163 R |

FOREIGN PATENT DOCUMENTS

| | | | |
|---|---|---|---|
| 364845 | 1/1932 | United Kingdom | 273/174 |
| 377463 | 7/1932 | United Kingdom | 273/167 A |

*Primary Examiner*—George J. Marlo

*Attorney, Agent, or Firm*—Kinney & Lange

[57] ABSTRACT

A golf club, as disclosed a putter, having an interchangeable runner on the bottom that is held in place with screws or double-sided adhesive tape. The runner is capable of being shimmed or changed by an individual golfer to vary the vertical height or thickness in order to raise or lower the face of the club and thus adjust the position of the "sweet spot" of the club face. The desired location of the sweet spot is determined by finding the center marking of the normal ball input point distribution for a plurality of impact points on a marking tape placed on the face of the club. A sighting line also can be aligned with the center of the pattern of impact points.

9 Claims, 3 Drawing Sheets

GOLF CLUB

BACKGROUND OF THE INVENTION

1. Field of the Invention

The present invention relates to providing means for adjusting the geometric center of a sampling of impacts on a golf club face for a golfer toward the "sweet spot" on the club face.

2. Description of the Prior Art

Various devices for guiding the vertical position of a golf club face relative to the ground surface or grass surface have been advanced, including units which have rollers to provide reduced friction, and also clubs which have replaceable skid plates.

U.S. Pat. No. 2,057,275 shows a golf club that has a retractable spacing stand which is intended to space the bottom of the club at a predetermined distance from the ground at the beginning of a stroke. This is primarily for use on a driver. No teaching is disclosed of utilizing a runner to engage the grass or green surface prior to a stroke to provide a centering of the normal range of impact points with respect to the club sweet spot.

Sole plates have been used on golf clubs as well, and such plates are shown in U.S. Pat. No. 1,289,192. Replaceable bottom plates are shown in U.S. Pat. Nos. 2,328,583 and 2,332,342. The last mentioned two patents were issued to the same inventor, and relate to proper weighting of the golf clubs by having a removable section where weights can be added or subtracted.

U.S. Pat. Nos. 2,255,332 and 3,680,868 show roller balls on the bottom surface of golf clubs to reduce friction. These rollers are replaceable. Replacement of one type rollers with different size rollers is disclosed in U.S. Pat. No. 3,680,868.

A type of sole plate that has a raised center portion that is part cylindrical is shown in U.S. Pat. No. 2,004,968, and U.S. Pat. No. 2,090,348 shows a golf club that has flexible support fingers on the bottom surface thereof that are to space the club properly from the ground or grass surface. This is used primarily as a training device in connection with a special recording surface that will record and illustrate the direction of swing.

None of these, however, teach the use of a runner on the bottom of the club head that provides a smooth low friction surface, and which also is adjusted to insure that the most likely impact point will be close to the "sweet spot" of the club. This "most likely impact point" is the center of a number of ball-club impact points resulting from any individual golfer's natural swing. As part of the method of moving the most likely impact point toward the sweet spot, the present device also includes an adjustable aiming line. Aiming devices are known in the prior art, and for example U.S. Pat. No. 1,969,086 shows a sight point that can be adjusted to different positions between the heel and toe of a putter, but does not provide an alignment line or arm that makes it easy to hold the face of the club square relative to the plane of club swing. Other patents that show direction indicator attachments for golf clubs include U.S. Pat. Nos. 3,719,363, and 4,291,883. The latter patent shows a device that can be adjusted as to angle if desired. U.S. Pat. No. Des. 111,855 also shows a clip-on direction indicator attachment for a golf club.

None of these patents teach the adjustment of guide devices in a method that starts with establishing a normal swing pattern of a selected number of swings and recording ball impact points on the club face, and then adjusting the runner to bring the geometric center of such impact points toward the sweet spot on the face of the club.

The sweet spot on a golf club is defined generally and for purposes of this specification as point on the face (also called striking surface) where the greatest distance results from a given velocity of the club head, following impact with a ball at rest. The sweet spot is close to that point on the hitting surface which is directly ahead (or possibly behind) the center of gravity of the hitting surface, in the swing direction. It is not necessarily coincident with this point, for a variety of reasons.

Nearly all golfers "set up" a shot by first resting the club on the grass, then draw it back and make the swing. With a putter, contact with the grass is sometimes made unintentionally during the swing, and for such cases, friction against the grass is preferably minimal.

SUMMARY OF THE INVENTION

The present invention relates to a golf club construction that provides a runner for reducing the friction of the club head with the surface in case of contact and which is adjustable in its vertical height so that the surface of the runner that engages the grass can be spaced at different distances from the bottom of the club head itself to adjust the vertical position of the sweet spot of the club face relative to the ground when the runner rests on the ground. Many golfers seldom impact the golf ball right on the sweet spot of the club, but most golfers will have a normal range or scatter of ball impact points that will be repeatable within a relatively small area. If the center of this scatter area of impact points is positioned to substantially coincide with the sweet spot, the golfer's scores will decrease, and better results may be noticed.

Even with aiming devices, the center of the golfer's range of impact points may be offset from the sweet spot, and by moving the aiming device appropriately, the center of a range of impact points can be moved closer to the sweet spot in heel and toe direction for improving results.

The present invention provides a runner that is changed in height to adjust the vertical position of the club with the runner on the grass. Use of shims, replacing one runner with another of different vertical height or thickness, or even screw adjustments may be used for changing the club position. The aiming device disclosed is applied to a club surface with double adhesive tape and can be moved to a location which shifts the golfer's natural region of impact points along a line between the heel and toe of the club. The changing of the runner thickness shifts the center of impact points vertically along the face of the club.

Additionally, a method for determining in which direction the center of impact points that are natural to the golfer should be shifted comprises utilizing a type of a marking tape or marking material on the golf club face that indicates where a golf ball impacts the club, and will leave a dot indicating such impact. Then, the golfer will swing 20 or so times, leaving a pattern of impact points that will have a visually perceivable geometrical center. After determination of the center of normal impact points, appropriate adjustments in the height of the runner, and/or the position of the aiming line can be made to shift the natural center of the impact points to, or closer to, the sweet spot of the club face.

The use of runners and the method of adjustment is particularly useful with putters, but the arrangement also will work on other golf clubs.

DETAILED DESCRIPTION OF THE PREFERRED EMBODIMENTS

Figure 1:
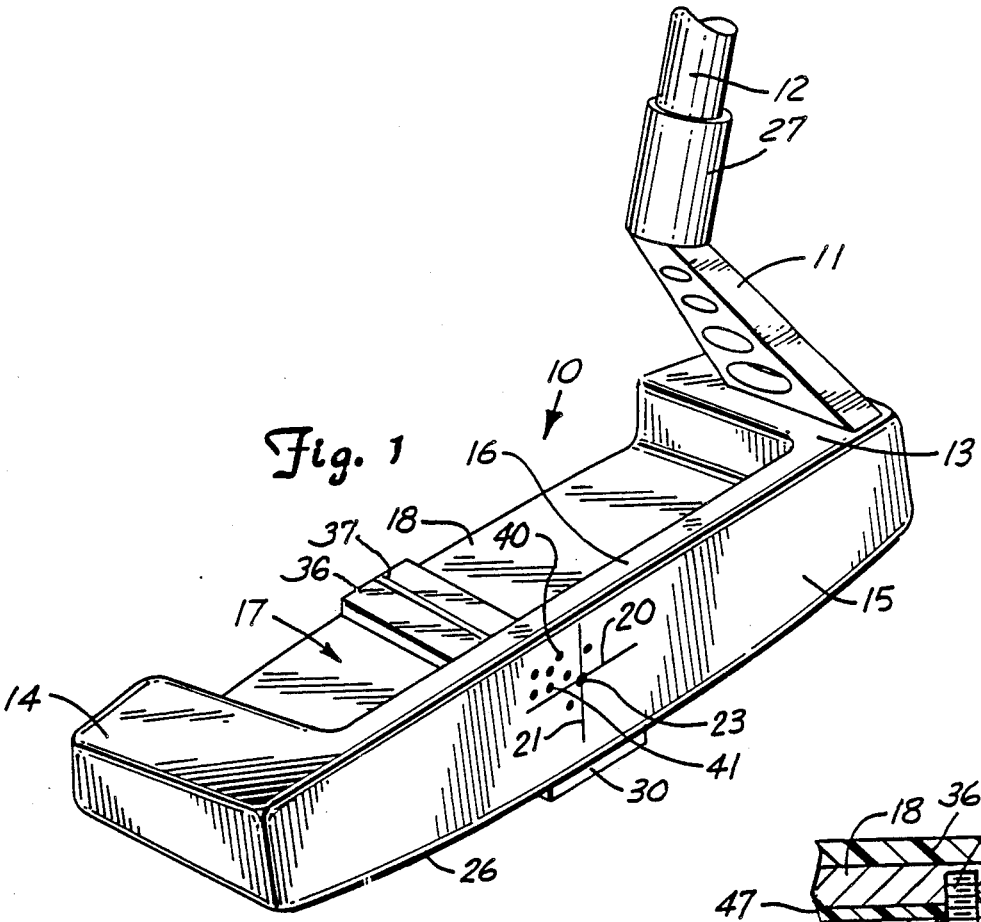
FIG. 1 is a perspective view of a golf club, as shown a putter, having a runner made according to the present invention installed therein, and also an aiming member positioned according to the present invention thereon.

A golf club indicated generally at 10, as shown a putter, has a neck 11, in which a shaft 12 is mounted that is used for swinging the club. The club has a heel portion 13 where the neck 11 joins, a toe portion 14, and a club face surface 15 that is generally inclined with respect to the ground at a desired inclination. The face 15 is on a wall 16 as shown to form an interior depression or receptacle 17 at the rear side of the face, extending in aft direction from the forward face 15. The receptacle is above a bottom wall 18.

Figure 4:
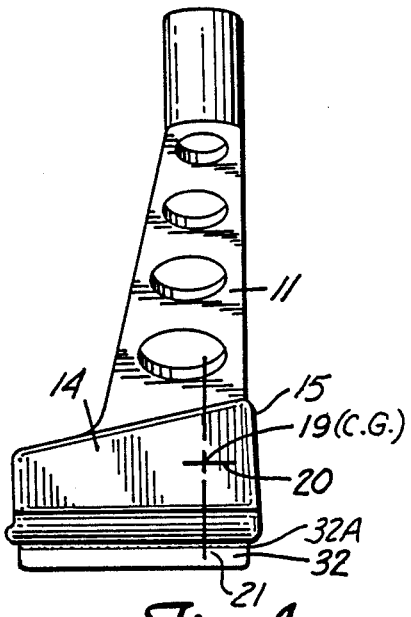
FIG. 4 is a side elevational view of the putter of FIG. 1.

The club is designed to have a center of gravity 19 that is spaced rearwardly from the face 15, and would lie along the intersection of a horizontal plane 20, and a vertical plane 21 parallel to the face surface. The center of gravity is also spaced rearwardly from the face 15 as shown in FIG. 4. The "sweet spot" of the club is represented as being at the point shown generally at 23.

Figure 2:
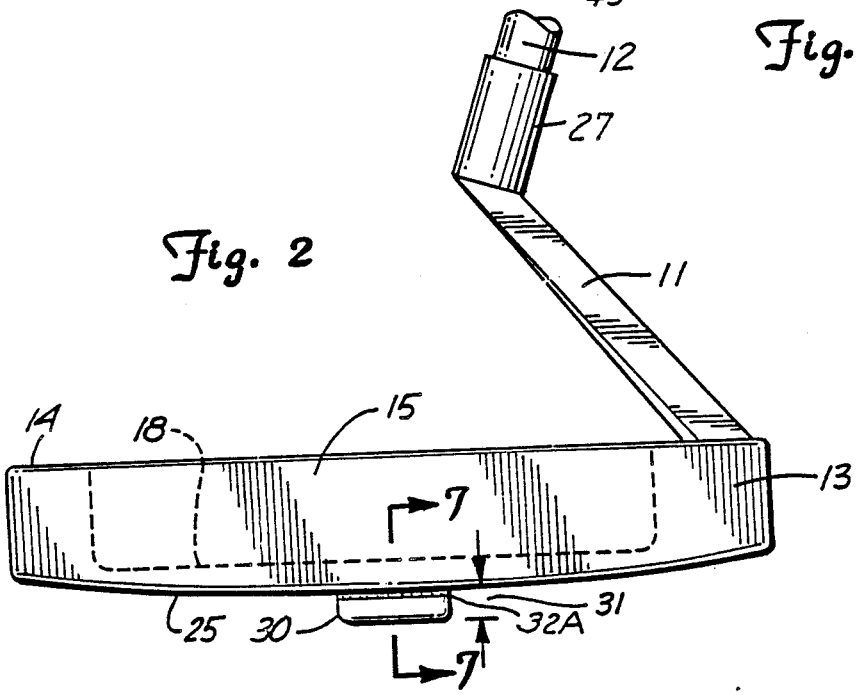
FIG. 2 is a front view of the face of the putter of FIG. 1.
Figure 6:
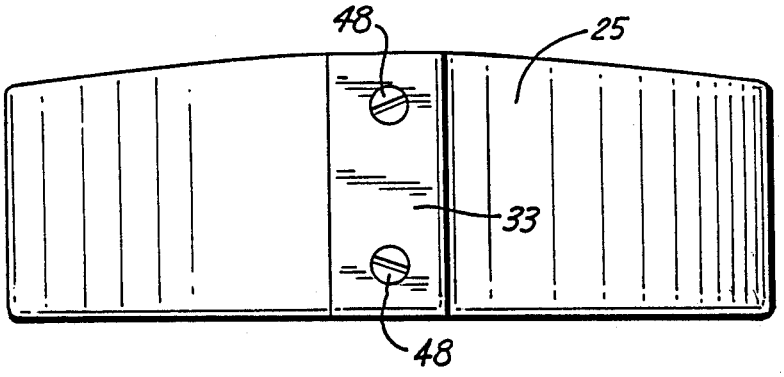
FIG. 6 is a bottom plan view of the putter of FIG. 1.

The club also has a bottom surface 25, which is shown perhaps best in FIG. 6, and as can be seen in FIG. 2, for example, the bottom surface 25 has a slight heel to toe curve between the heel 13, and the toe 14 of the club. The bottom surface 25 joins the front face 15 along a lower leading edge 26 of the club.

A shaft 12, on which a grip is mounted, is connected to the neck 11 using a coupling- sleeve 27. In this form of the invention, .a runner shown at 30 in FIGS. 1 and 2 is fixed to the bottom surface 25 in a suitable manner. The runner 30 has a height indicated by the dimension lines 31. The height of the runner used on a club can be changed by way of providing a different height, replaceable runner, or as will be explained by having shims or layers.

Figure 3:
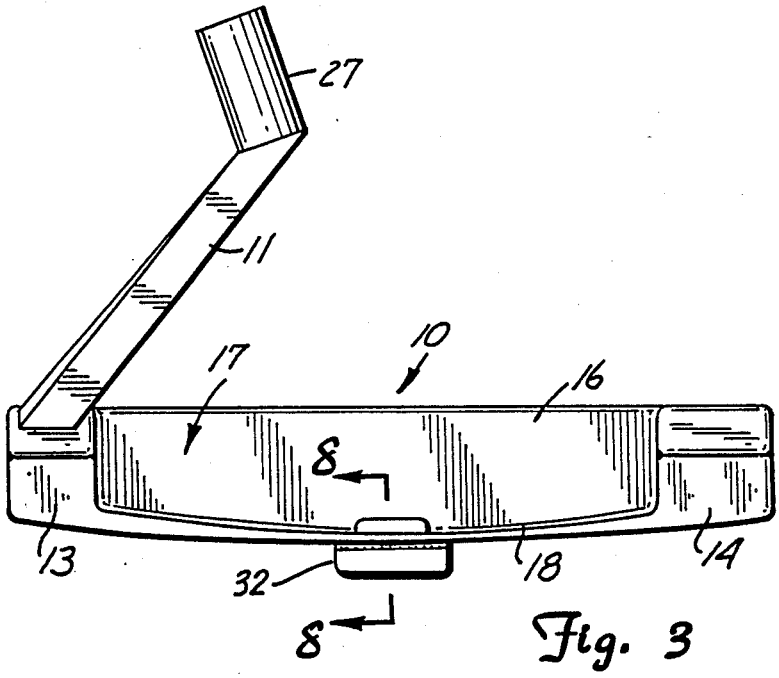
FIG. 3 is a rear elevational view of the putter of FIG. 1.

An alternate, thicker runner is shown at 32, in FIGS. 3 and 4. Runners of different vertical height can be used and held in place with double-sided adhesive tape 32A, as will be explained.

Additionally, the runner has a narrow width in direction from heel to toe and has a smooth bottom surface 33 that provides a low friction surface for engaging the grass or ground of the green or fairway which sometimes happens by accident during the swing. As can be seen in FIG. 6, the runner 30 extends nearly all the way along the fore to aft direction of the bottom surface 25 but may be somewhat shorter, if preferred, for example, the runner can be closer in length to give reasonable stability when setting up the shot and that is all that is needed.

The runner is generally aligned with the vertical plane that passes through the center of gravity, and is centered thereon in the direction from heel to toe.

Additionally, a sighting or direction indicating strip indicated generally at 36 is positioned on an upper surface of the bottom wall 18 of the putter. The strip 36 has an elongated straight direction line 37 thereon which can be white, for example if the strip 36 is dark colored, so the line can easily be seen. Strip 36 extends for nearly the full fore to aft direction between the back edge of the forward wall 16 of the club head and the aft edge of the head, so that a maximum length of straight line 37 is obtained. The line 37 is perpendicular to the face 15 and parallel to the plane of swing of the club. The axis of the straight line 37 is located to provide the best results for a golfer.

Line 37 is a sighting line for lining up the club face relative to the ball, and aids in orienting the face so that it is perpendicular to the plane of swing.

However, as can be seen in FIG. 1, in the method of determining where to place the sight line, and how thick to make the runner on the bottom, a golfer using the club 10 is provided with a desired type of a marking tape or marking layer (such as a marking dye) on the face 15, and the ball is hit a number of times by the golfer using a normal swing and using both an aiming line and a runner, so that there are a number of individual impact points 40 shown on the club face. These points 40 have a normal scatter range or area, and the center 41 of the general area of these impact points is not always coinciding with the sweet spot 23 on the face of the club. For example, in FIG. 1, if the geometrical center of the impact points 40 are at the location indicated at 41, this center is above the horizontal line or plane 20 and is to the toe end of the club from the vertical plane 21 and is offset from the sweet spot 23.

To position the center 41 of the normal impact points closer to the sweet spot and thus tend to increase average performance, the runner 30 is adjusted so that the height dimension 31 is different, for example by replacing the runner that is shown at 30 with a thicker runner which is shown at 32 so that utilizing the same positioning of the runner the center 41 would be lowered toward the sweet spot (or stated alternately, the club is raised to agree with the location 41).

Figure 7:
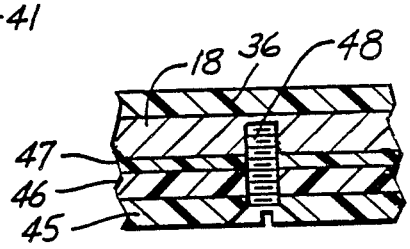
FIG. 7 is an enlarged sectional view showing a form of attaching shims to vary the height of the runner of the present invention.
Figure 8:
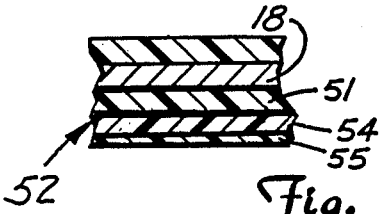
FIG. 8 is a view showing a modified runner adjustment construction made according to the present invention.

Alternate ways of changing the height dimension between the surface 33 of the runner and the sweet spot 23, or in other words changing the height dimension between the edge 26 and the runner surface 33, is by providing for a plurality of shims such as that shown in FIG. 7, where a runner indicated at 45 can be shimmed with shims 46 and 47 that can be of different vertical heights or thicknesses in place on the lower surface of the bottom wall 18 of the club through the use of screws 48 that have recessed heads. These screws 48 can be seen in FIG. 6, for example. By removing one or more of the shims 46 or 47, the height dimension 31 of the runner can be changed. Additionally, if the runner is held on with double-sided adhesive tape, one runner can be removed and replaced with a thicker runner as shown at 32. Additionally, as shown in FIG. 8, a runner assembly indicated generally at 52 can be made up of individual layers 51, 54 and 55 that are adhesively secured together, and in turn adhesively secured as an assembly to the bottom wall 18 of the golf club. By removing the layer 55 (or adding a layer 55), the vertical height of the runner can be changed. Additionally, adjustable plates can be used with set screws or brackets that hold the lower surface of the runner at a known relationship with respect to the bottom surface 25 of the club.

The leading end of the runner (when the club is moved to strike a ball) can be rounded so that it does not tend to dig in, should the golfer accidentally swing too low to the grass. The runner provides a low friction runner for the club.

Figure 5:
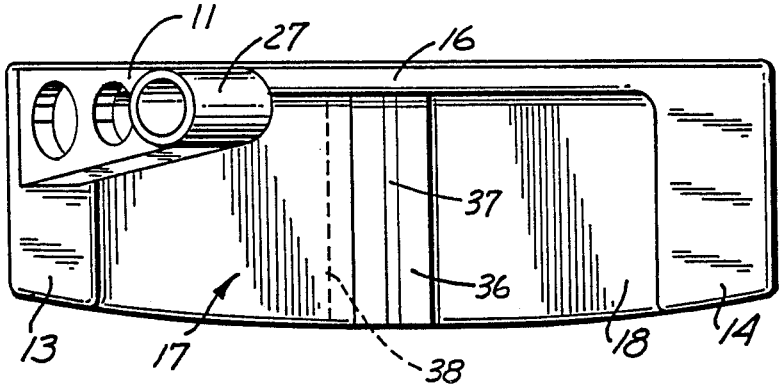
FIG. 5 is a top plan view of the putter of FIG. 1.

In order to change the horizontal position of the geometric center of the normally scattered impact points, which center is shown at 41, with respect to the sweet spot 23 (and thus shift the center 41 in the heel and toe direction), the alignment strip 36 having the line 37 thereon can be moved in direction between the heel and the toe of the club, while the line 37 is maintained perpendicular to the face 15. In other words, with the center of impact points shown at 41, the alignment strip 36 would be moved toward the heel, generally as represented by the dotted line 38 in FIG. 5.

The runner can be used for moving the center of the normal impact pattern toward the club sweet spot, by adjusting the runner vertical height relative to the edge 26 between the bottom surface of the club and the face. The bottom surface 33 of the runner is moved relative to the horizontal plane passing through the center of gravity of the club.

Adjustment of club height with a runner will work on many types of clubs, but has particularly application for a putter where the use of a runner can be advantageous for the type of stroke used in putting. The impact point of the ball on a putter face is not generally seen or easily determined, and this method and apparatus will permit changing the normal impact point to be closer to the sweet spot.

Although the present invention has been described with reference to preferred embodiments, workers skilled in the art will recognize that changes may be made in form and detail without departing from the spirit and scope of the invention.

What is claimed is:

1. In a golf club having a face with a preferred location known as a sweet spot for impacting a golf ball with the face, a bottom surface, and a leading edge where the face joins the bottom surface, the improvement comprising a runner on the bottom surface and extending along the bottom surface in direction away from the face, the runner having a runner bottom surface the bottom surface of the club and means for permitting adjusting the spacing between the runner bottom surface and the club bottom surface to vary the vertical height of the sweet spot above the runner bottom surface and thereby adjust the vertical height of the sweet spot of the club when the runner is resting on a supporting surface.

2. The improvement of claim 1 wherein said means for changing the spacing of the bottom surface of the runner relative to the bottom surface of the club comprises a plurality of runners having different thicknesses, said runners being individually fixed to the bottom surface of the club and being selectively removable for replaceable of a different thickness runner.

3. The improvement of claim 2 wherein said runners are adhered to the bottom surface of the club with a double sided adhesive tape.

4. The improvement of claim 1 wherein said runner comprises a strip of material having a desired length extending from adjacent the face toward the trailing edge of the golf club along the bottom surface thereof.

5. The improvement as specified in claim 1 wherein said runner is adjustably mounted on said club, and means for providing an adjustment in a vertical direction of the runner relative to the edge of the club face.

6. The improvement of claim 5 wherein said means for providing adjustment comprises shims positionable between the runner and bottom surface of a golf club.

7. The improvement of claim 1 including an elongated aiming strip means having a straight aiming line generally perpendicular to the face of the club, said aiming strip being adjustably positionable between the heel and toe of the club to a desired location.

8. A method for moving the center of a pattern of impact points on a golf club face caused by swings of a particular golfer towards a spot on the club face in alignment with a preferred line of impact known as a sweet spot of such club, comprising the steps of:

providing means for marking point of impact of a golf ball on a golf club face;

swinging the club to hit a golf ball for a plurality of times sufficient to provide a visually identifiable pattern of impact points for a golfer swinging the club;

determining the approximate center of the visually identifiable pattern of impact points;

providing a runner on the bottom surface of the club, which runner has a surface for engaging the ground; and adjusting the vertical height of the runner to move the center of the pattern of impact points in a direction toward the level of the sweet spot of the club.

9. The method of claim 8 including the steps of providing an adjustable aiming line generally perpendicular to the club face, and adjusting the aiming line in a direction to move the center of the pattern of impact points move along a line between the heel and the toe of the club closer to a vertical plane passing through the sweet spot.

* * * * *

UNITED STATES PATENT AND TRADEMARK OFFICE

CERTIFICATE OF CORRECTION

PATENT NO. : 4,832,344

DATED : May 23, 1989

INVENTOR(S) : Frank D. Werner

It is certified that error appears in the above-identified patent and that said Letters Patent is hereby corrected as shown below:

Column 5, lines 52-53, after "surface", insert "spaced from".

Signed and Sealed this

Ninth Day of January, 1990

*Attest:*

JEFFREY M. SAMUELS

*Attesting Officer*

*Acting Commissioner of Patents and Trademarks*